US005660514A

United States Patent [19]

Wilson

[11] Patent Number: 5,660,514

[45] Date of Patent: Aug. 26, 1997

[54] METHOD OF MAKING POCKET LINER FOR COVERS OF LOOSELEAF BINDERS OR BOOKS

[75] Inventor: Robert Bruce Wilson, So Hadley, Mass.

[73] Assignee: Specialty Loose Leaf, Inc., Holyoke, Mass.

[21] Appl. No.: 524,704

[22] Filed: Sep. 7, 1995

[51] Int. Cl.[6] ..... B42C 7/00

[52] U.S. Cl. ..... 412/1; 412/3; 281/29; 281/31; 402/73

[58] Field of Search ..... 281/29, 31; 402/73; 283/64; 493/947; 229/67.1; 156/60, 87, 283, 908; 412/3, 900, 902, 1

[56] References Cited

U.S. PATENT DOCUMENTS

| | | | |
|---|---|---|---|
| 1,708,811 | 4/1929 | Von Auw | 402/73 |
| 2,105,232 | 1/1938 | Schade . | |
| 2,611,369 | 9/1952 | Herrick | 229/67.1 |
| 2,704,546 | 3/1955 | Slonneger . | |
| 2,809,852 | 10/1957 | Miller | 281/29 |
| 3,858,790 | 1/1975 | Humphrey . | |
| 4,296,945 | 10/1981 | Pavlik . | |
| 4,600,346 | 7/1986 | Podosek | 412/3 |
| 4,629,349 | 12/1986 | Pitts . | |
| 4,838,724 | 6/1989 | Spence, Jr. . | |
| 5,215,398 | 6/1993 | White et al. | 402/73 |
| 5,411,293 | 5/1995 | Monzyk | 281/29 |
| 5,417,509 | 5/1995 | Schwartz | 281/31 |
| 5,445,417 | 8/1995 | Bromer et al. | 412/3 |

FOREIGN PATENT DOCUMENTS

| | | | |
|---|---|---|---|
| 1060841 | 7/1959 | Germany | 281/31 |

*Primary Examiner*—David P. Bryant
*Attorney, Agent, or Firm*—Robert A. Seemann

[57] ABSTRACT

A flexible sheet having the back coated with a glue is formed into panels which are folded back on themselves with at least one layer being the back glued to itself by the coating. In one embodiment the glue is an energy responsive adhesive, and energy is applied to the folded sheet while it is on a cover, so that a cover having the cover liner with reinforced pocket is made.

21 Claims, 7 Drawing Sheets

METHOD OF MAKING POCKET LINER FOR COVERS OF LOOSELEAF BINDERS OR BOOKS

BACKGROUND OF THE INVENTION

1. Field of the Invention

This invention is concerned with binders which releasably engage sheets of paper, plastic sleeves, and other materials, usually by apertures or notches in the materials. It is also concerned with books and the like which obtain benefit from pockets on their covers.

Specifically, the invention relates to an inexpensive and quick method of making a cover liner with a strong and wear resistant pocket.

2. Description of the Prior Art

Paper liners and pockets for paper covers are typically made in a succession of steps which include applying separate layers or folds to a cover and spot or line sealing of the layers, folds and cover with glue or adhesive.

Thermoplastic liners and pockets for plastic covers are also made in a succession of adding layers in which the assembled pieces are joined by fusing of adjacent thermoplastic surfaces by heat sealing or ultrasonic welding.

The methods are relatively slow and costly because they require several hand labor steps. For example, in fusing thermoplastic cover liners and pockets, the heat applicator shoe or ultrasonic horn has to apply energy in a specific pattern, and accurate alignment between the shoe or horn and the binder elements is necessary.

Another drawback is that tooling for assembling paper and thermoplastic cover liners and pockets is design specific, and must be changed to accommodate a change in design, such as a shape of a pocket on a cover of a binder.

The art is replete with patents for cover liners with pockets, and methods for making them.

For example, U.S. Pat. No. 2,105,232, patented Jan. 11, 1938 by F. S. Schade describes a method of forming a casing with a pocket, for a case-made looseleaf binder. The construction includes laying together plys of cardboard, perforating hinge rows and perforating adjacent rows in the cardboard through which cement is passed to cement together the ply panels and a metal stay which receives the ring mechanism. A strip of cardboard the width of a pocket is cemented to an outer edge of the inside face of the cover so that it is attached like a flap. A cover sheet is then placed on the outside face of the cover. Edges of the cover sheet are wrapped around three edges of the cover and are pasted down whereby they close over two more edges of the pocket flap. A single lining sheet is pasted over the inside face of the cover including the pocket. The opening of the pocket is then freed, or made accessible, by slitting the liner sheet.

U.S. Pat. No. 2,704,546, patented Mar. 22, 1955 by B. K. Slonneger describes a ring binder having a plastic sheet electrothermally sealed on three edges to the top, bottom and outer edge of a plastic cover of the binder, leaving the inward edge of the sheet free so that a pocket is formed which opens toward the binder rings at the center of the binder. To secure items which may be installed in the pocket, the free edge of the sheet includes an extension that is punched to fit on the rings.

Capturing the extension in the rings blocks the opening of the pocket. If leather, paper or other sheet material is used instead of plastic, stitching or gluing may be used instead of sealing by fusing.

U.S. Pat. No. 4,629,349, patented by W. R. Pitts, Dec. 16, 1986, describes a looseleaf notebook having two plastic sheets heat-sealed together at their left and right edges and their bottom edges to form between them a pocket that is opened at their top edges. A binder mechanism is mounted vertically at the center of the pocket by bolting through both sheets so that the pocket is divided into two pockets by the mechanism attachment.

Each pocket then becomes a cover for the notebook when they are folded together with the binder mechanism being the spine for the notebook.

SUMMARY OF THE INVENTION

It is one object of the invention to provide an inexpensive and easy to manufacture pocket liner for a cover of a binder or book.

It is another object that the pocket liner be made in a single sheet.

It is another object that the pocket liner be made in a single, folded unit.

It is another object that the pocket of the pocket liner be reinforced.

It is another object that the pocket liner be constructed with self contained adhesive.

It is another object that the pocket liner and cover be permanently adhered in a single operation.

It is another object that the pocket liner and cover be permanently adhered by activating an externally activated adhesive in a single operation.

It is another object that a single energy transmittal shoe design may be used to permanently adhere any of a plurality of pocket configurations.

Other objects and advantages will become apparent to one reading the ensuing description.

A flexible sheet having essentially the entire back coated with an energy responsive adhesive is, in any order;

(a) folded between a first panel portion of the sheet and a second panel portion of the sheet so that the front of the second panel portion is in contact with the front of the first panel portion, and (b) folded between a third panel portion and the second panel portion of the sheet so that the back of the third panel portion is in contact with the back of the second panel portion, and (c) the panel portions are formed dimensionally so that an end of the third panel portion extends beyond the second panel portion when the third panel portion is on the second panel portion, and activating energy is applied to the folded sheet while the back of the folded sheet is against a cover until the back of the second panel portion adheres to the back of the third panel portion, and the back of the third panel portion adheres to the front of the first panel portion.

The second panel portion may be made gas permeable.

The panel portions may be formed so that an end of the first panel portion extends beyond the second panel portion when the first panel portion is on the second panel portion.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
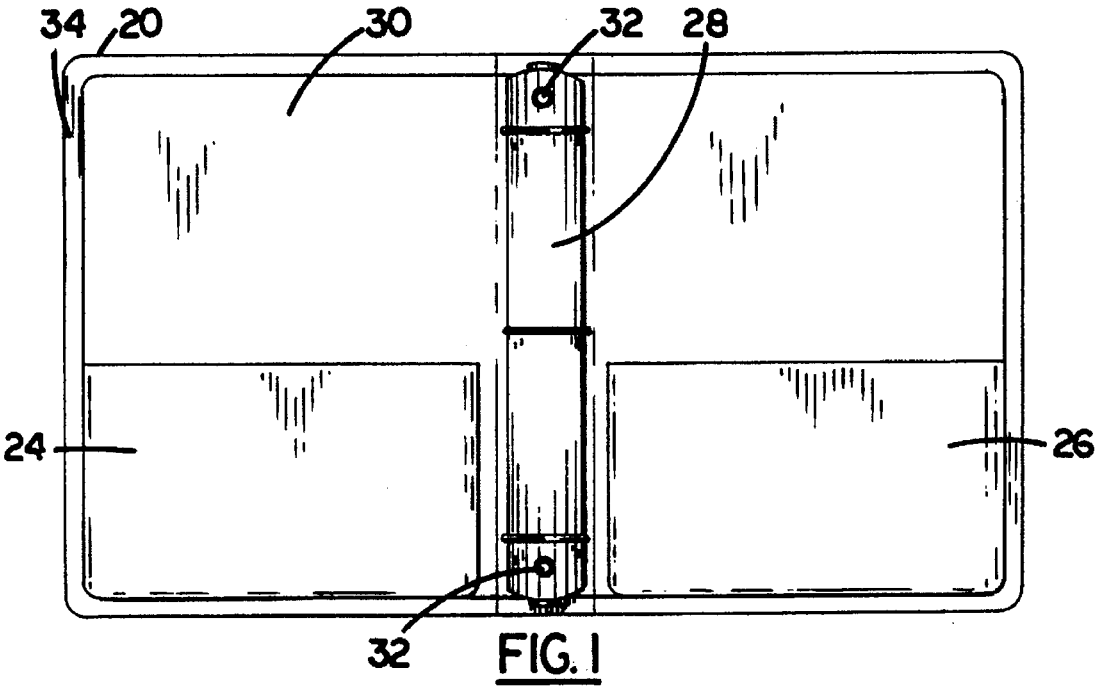
FIG. 1 is a front view of an open binder with a liner and pockets according to the invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1, looseleaf binder 20 has two pockets 24 and 26, and liner 30, adhered to cover 34.

Ring mechanism 28 is attached to cover 34 by studs 32.

Cover 34 may be made of plastic, cardboard or any suitable material.

Liner 30 is one piece in common with the pockets. It may be made of plastic, paper, cloth or other suitable material, and need not be of the same material as the cover.

Figure 2:
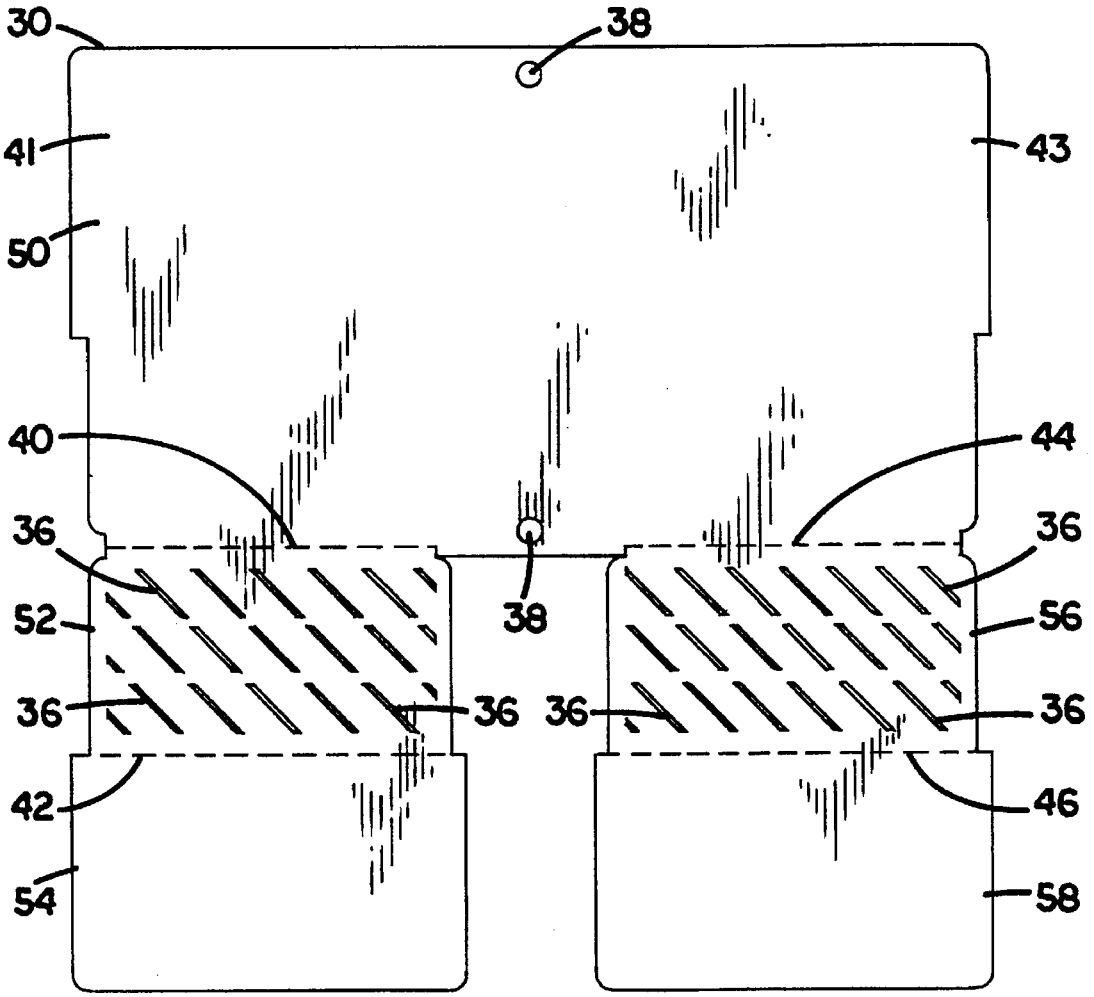
FIG. 2 is a front view of the liner of FIG. 1.
Figure 3:
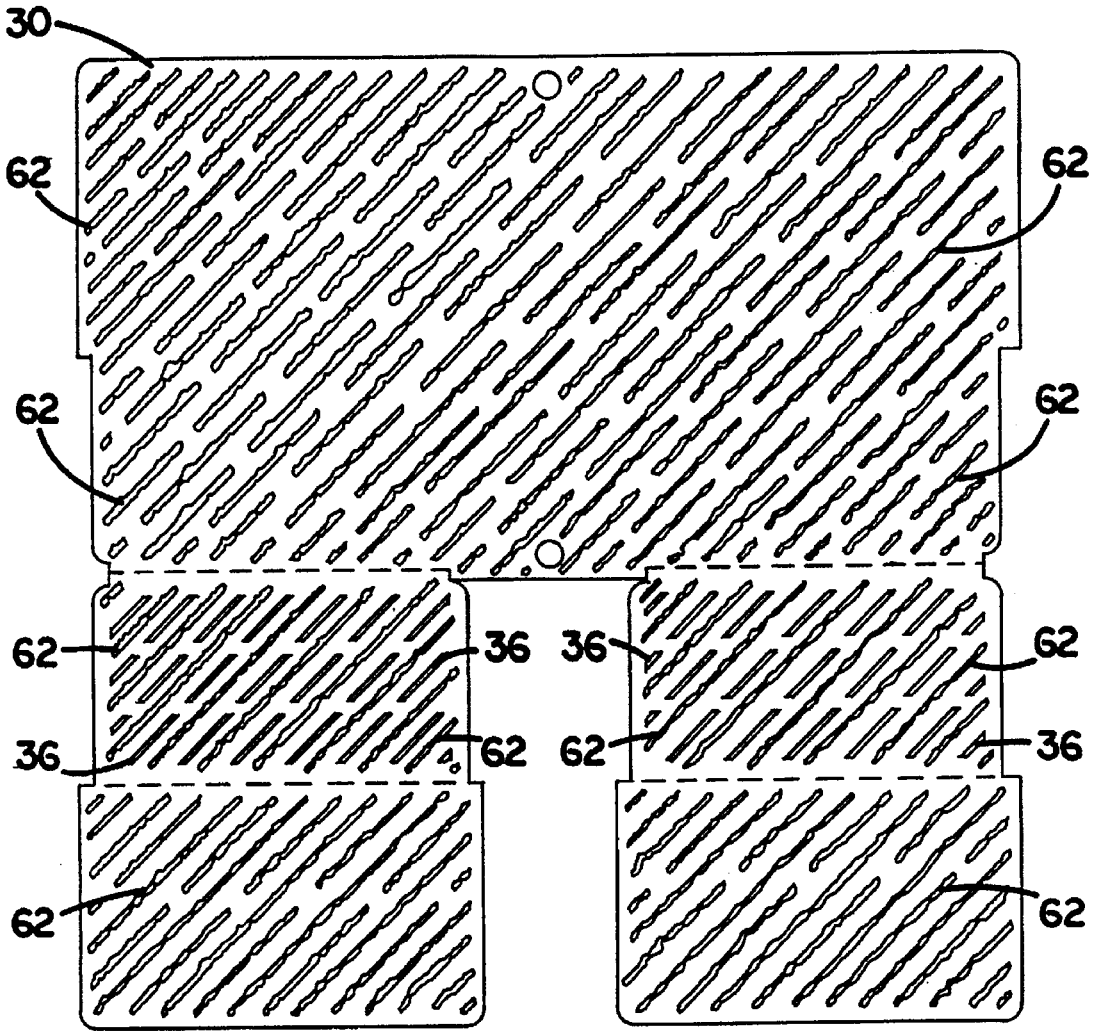
FIG. 3 is a back view of the liner of FIG. 2.

Referring now to FIGS. 2 and 3, liner 30 is die cut from a flexible vinyl sheet. The scrap sheet material left after the stamping is not shown.

The front of liner 30 is shown in FIG. 2, the back is shown in FIG. 3.

Fold line 40 across liner 30 extending toward sides 41 and 43 of liner 30 differentiates panel 50 portion of liner 30 from panel 52 portion of liner 30. Fold line 40 denotes a hinge upon which panel 52 can rotate toward panel 50. Fold line 40 is preferably a score line taking the form of a slit which extends predominantly across panel 52 but for narrow interconnecting portions between panel 50 and 52, so that when the panels are folded, the crease is not made fat by unnecessary connecting vinyl. Only enough connecting material is required to hold the panels together as they lie in storage and are handled and folded during assembly with a cover.

Fold line 42 differentiates panel 54 portion of liner 30 from panel 52 portion of liner 30. Fold line 44 differentiates panel 56 portion of liner 30 from panel 50 portion of liner 30. Fold line 46 differentiates panel 58 portion of liner 30 from panel 56 portion of liner 30.

In a preferred embodiment the pocket liner is precut to dimension so that the final product is made completely by folding the liner and gluing the folded die cut liner to a cover.

Preferably all the fold lines are parallel. This provides high efficiency in folding by hand and reduces the cost of automated folding equipment, as folding motions are along parallel directions.

Panels 50, 54 and 58 are preferably waterproof so that the resulting pockets are waterproof. Panels 52 and 56 are preferably gas permeable. The permeability in the base vinyl sheet of panels 52 and 56 is provided by perforations 36 through the panels. The perforations may be made simultaneous with the stamping of liner 30, and may take the form of holes, slits or other vapor passages. Alternatively, all of liner 30 may be made from an inherently porous material such as a cloth.

Openings 38 are provided for passage of studs 32 when ring mechanism 28 is fastened over liner 30 on cover 34.

Figure 15:
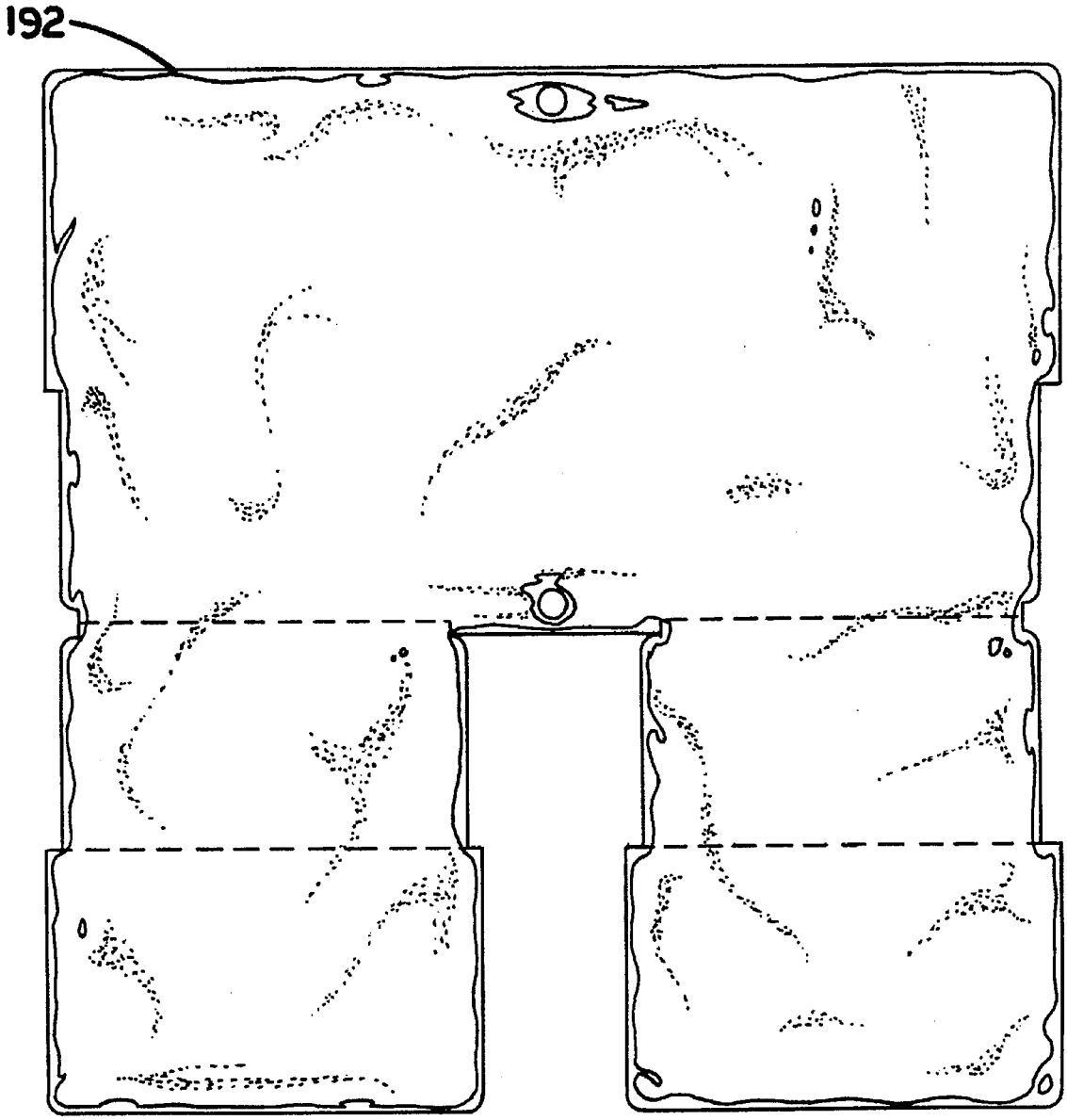
FIG. 15 is a back view of another liner according to the invention.

In a preferred embodiment, a dry, externally activated adhesive coating 62 such as a heat activated or pressure activated coating is on the back of liner 30. The coating in the invention may be in a pattern as shown in FIG. 3, or continuous as in FIG. 15. The pattern or continuous coating may cover essentially the entire surface of the back of liner 30 as shown in FIGS. 3 and 15, or may be in selected locations on the surface. Covering essentially the entire surface eliminates a need to synchronize the location of the coating so that it will fall in preferred places when the panels are folded.

Preferably a heat activated coating is used. Vinyl plastic sheet with heat activated coating on one side of the sheet is available commercially.

A pressure activated coating may be used. One should be used that has a low sensitivity to pressures encountered from ordinary handling such as folding or positioning the liner on the cover.

In another preferred embodiment described later for FIGS. 14 and 15, a glue, such as a water base glue, or such as a cement, covers the back of liner 30. The glue may be in a pattern or continuous. The pattern or continuous coating may cover the entire surface of the back of the liner. The glue should be fast drying.

The invention will now be further described with the externally activated coating covering essentially the entire surface. The description also applies to the invention with glue or cement. With glue or cement, however, external activating energy to cure the glue or cement need not be applied. Also porosity described for certain panels need not be provided.

As preferably all of the coating on the liner is activated during the pocket making process and is thereby involved in a bond, it does not interfere with later use of the completed pockets although they may be exposed to heat or pressure.

The externally activated adhesive, in combination with the adhesive being on essentially the entire back surface of liner 30, in combination with the folded portions of the liner, permits and provides a complete surface to surface seal between panels 52 and 54, and 56 and 58. It simultaneously further permits and provides thorough seal between panel 54 and panel 50 where panel 54 extends beyond panel 52 as they lie on panel 50. It simultaneously further permits and provides complete surface seal between panel 50 and cover 34. The above also applies to panels 56 and 58. It also permits making the seals, permanent and complete, simultaneously, with a generic energy transmission tool surface such as a roller or a uniform, cover-size plate.

In order to prevent buckling between panels 52 and 54 from gasses emitted from the adhesive during heat activation, gasses are vented through gas permeable panel 52.

Figure 4:
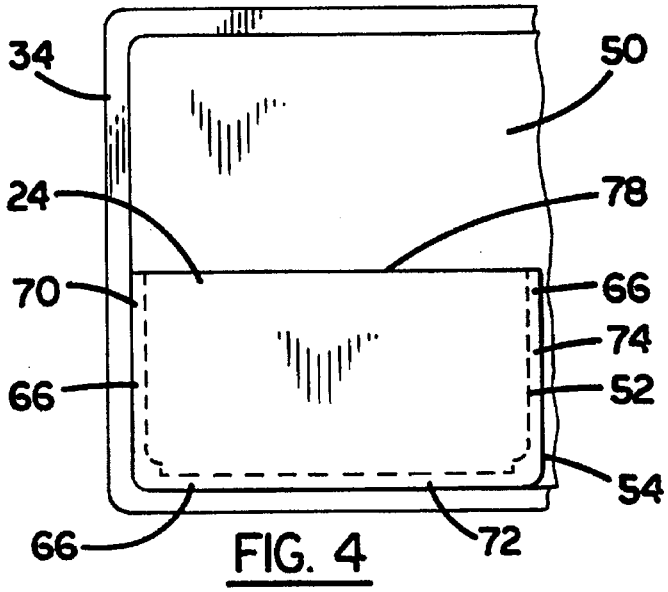
FIG. 4 is a front partial view of the left side of the binder of FIG. 1.

FIG. 4 shows panel 54 overlying panel 52. The backs of panels 52 and 54 are adhered together over their complete mutual contact surfaces, providing a reinforced pocket outer wall. A peripheral U-shaped margin 66 of the back of panel 54 is adhered to the front of cover 34 at sides 70 and 72, and to panel 50 at side 74. All of panel 50 is adhered to cover 34.

If desired, a portion of panel 52 adjacent to slit hinge 40 may be removed to further add adhering of panel 54 to panel 50 adjacent to slit hinge 40, resulting in panel 54 adhering to panel 50 at two edges of panel 54.

Since the front of panel 52 which is facing back against panel 50 is not adhered to panel 50, opening 78 of pocket 24 is upward.

Figure 5:
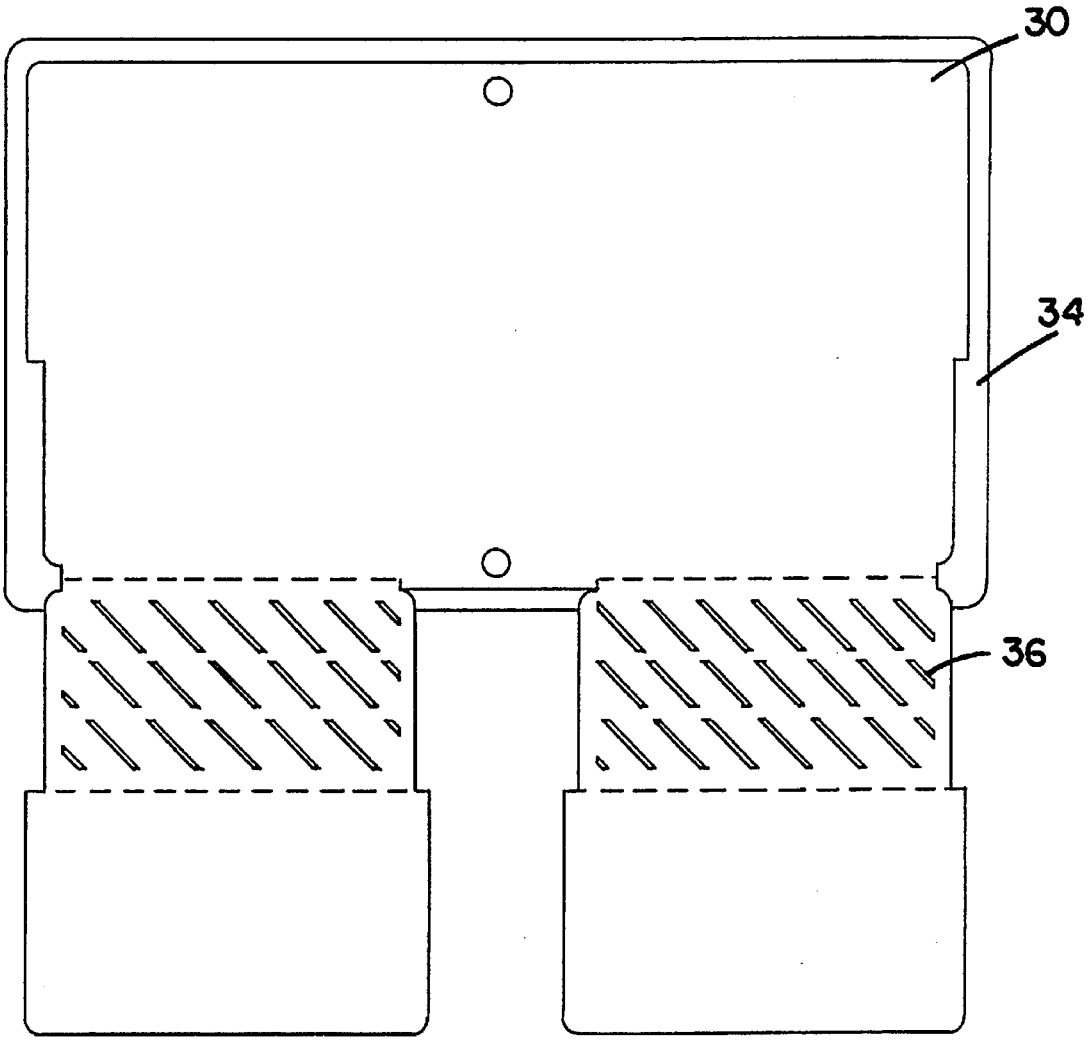
FIG. 5 is a front view of the liner of FIG. 2, positioned on the open binder for installation on the cover of the binder.

FIG. 5 shows liner 30, with the back having coating 62 facing down on cover 34, ready for installation on the cover by folding as in FIGS. 6–9 and applying of heat with a heat press as shown by arrows 80.

Liner 30 may be folded before or after it is laid on cover 34.

Figure 6:
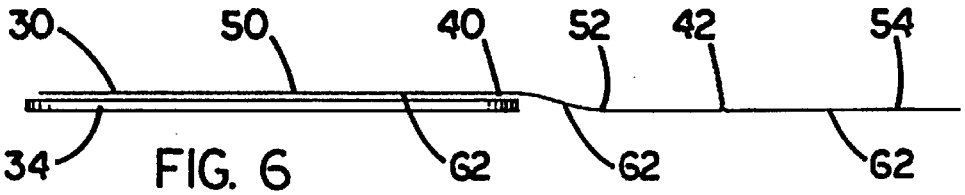
FIG. 6 is a side view of installation of the liner on the binder cover.

In FIG. 6, panel 50 is lying on cover 34, with the remaining four panel portions extending away from the cover. Only panels 50, 52 and 54 are shown in FIGS. 7–9.

Figure 7:
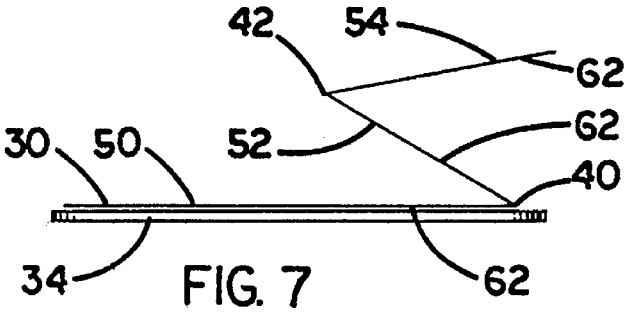
FIG. 7 is a side view of installation of the liner on the binder cover.
Figure 8:
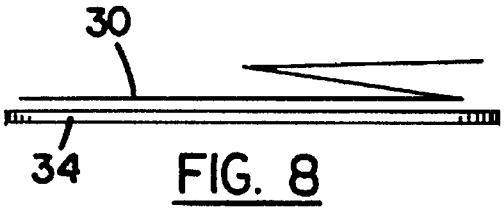
FIG. 8 is a side view of installation of the liner on the binder cover.

In FIGS. 7 through 8, progressively; panel 52 is folded on fold line 40 so that the front of panel 52 comes into contact with the front of panel 50; and panel 54 is folded on fold line 42 so that the back of panel 54 comes into contact with the back of panel 52.

Figure 9:
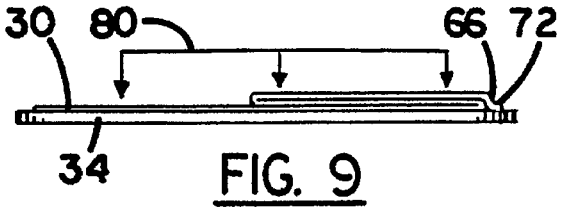
FIG. 9 is a side view of installation of the liner on the binder cover.

In FIG. 9, heat is applied until the back of panel 50 adheres to cover 34, the back of panel 54 adheres to the back of panel 52 and, beyond the edges of panel 52 panel 54 adheres to panel 50 and to cover 34.

Figure 10:
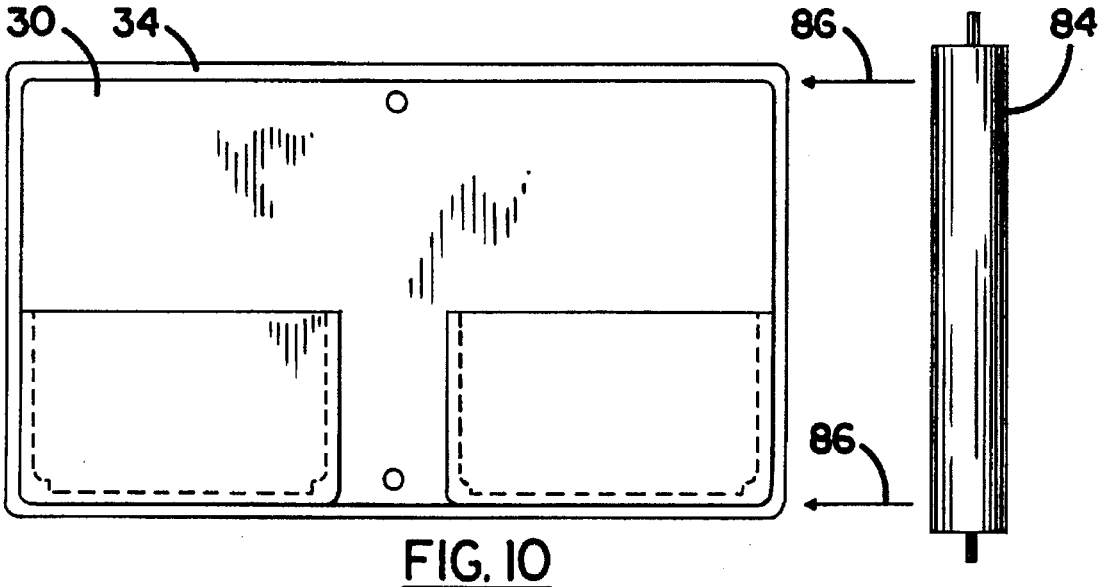
FIG. 10 is a top view of installation of the liner on the binder.

In FIG. 10, energy of heat or pressure, as necessary to activate coating 62, is applied externally to folded liner 30 by roller 84 which passes laterally 86 over the folded liner 30 on cover 34.

Figure 11:
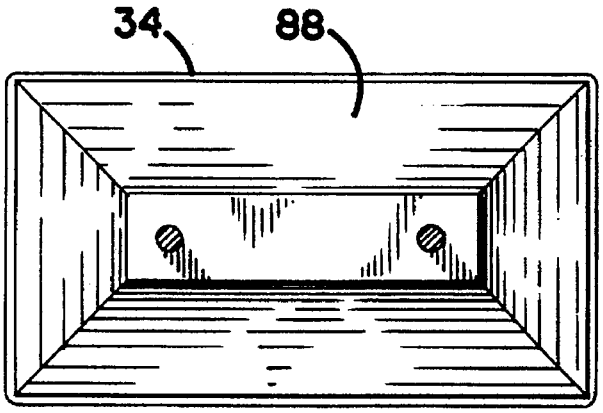
FIG. 11 is a top schematic view of installation of the liner on the binder.

In FIG. 11, instead of roller 84, energy of heat or pressure is applied externally to the folded liner by plate 88 which is brought down upon folded liner 30 on cover 34.

The same roller 84 or plate 88 can be used to seal any one of a number of various liner and pocket designs of the invention without change in dimensions of the roller or plate.

Figure 12:
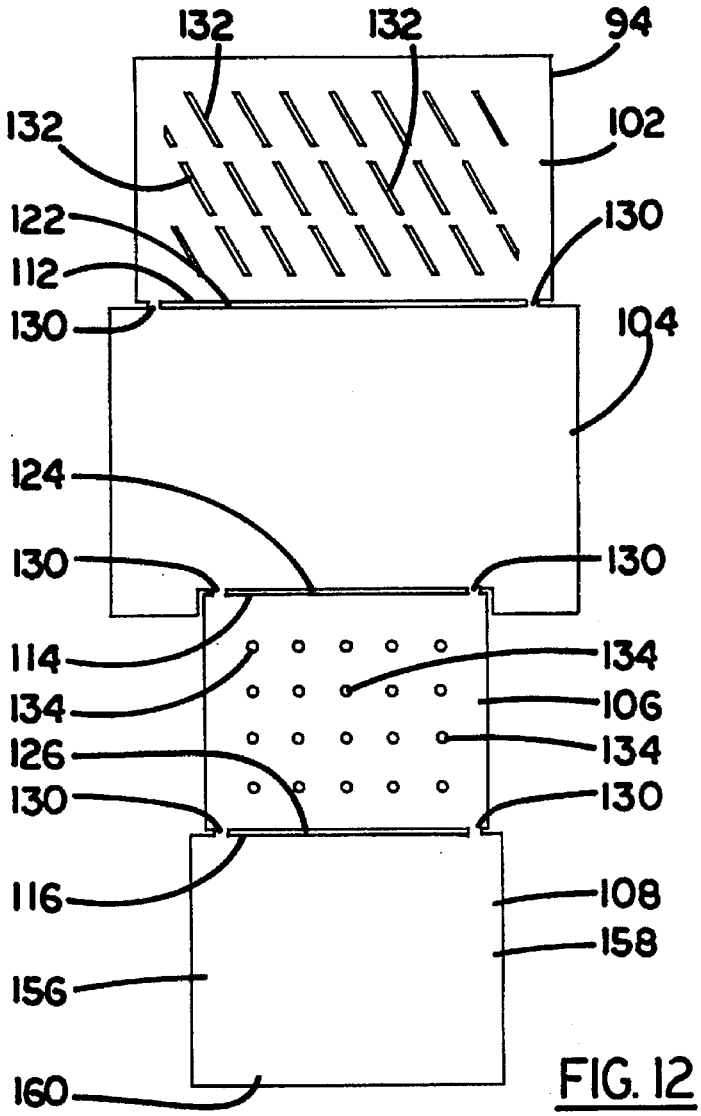
FIG. 12 is a front view of another liner according to the invention.

In FIG. 12, liner 94 is coated on the back (not shown) with a heat activated adhesive. Liner 94 includes panel portions 102, 104, 106 and 108.

Fold lines 112, 114, and 116 have respective slits 122, 124, and 126 which provide compact edges when the panels are folded over and sealed together. Sufficient connective material bridges 130 hold the panels together for storage and handling.

Panels 102 and 106 are gas permeable. The gas permeability being provided by slits 132 and holes 134.

Liner 94 is made from a single coated sheet of the same material for all parts, preferably a plastic.

The liner, however may instead be a sheet, the back of which is coated, in which the panels are made from different materials, such as woven natural fiber cloth for panels 102 and 106, and impervious plastic for panels 104 and 108. Bridges may be stitched or otherwise fastened to the panels to hold them together at the fold lines.

The coated liner sheet may be stored until it is needed to attach it to a cover.

Figure 13:
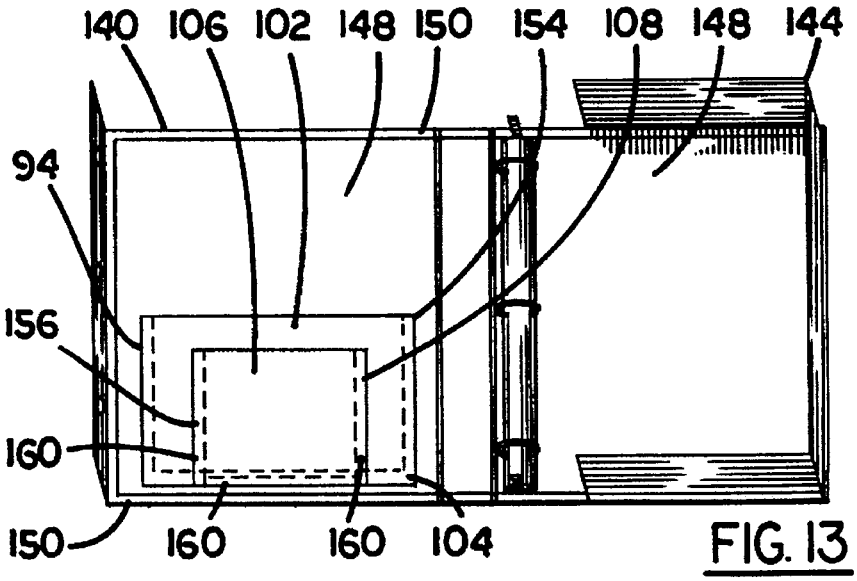
FIG. 13 is a perspective view of an open binder storage box with the liner of FIG. 12.

In FIG. 13, liner 94 is installed on cover 140 of binder storage box 144.

Cover 140 includes a full inside cloth liner 148, the edges of which extend over edges 150 of a simulated leather outside cover that is wrapped over the edges of cover 140.

Liner 94 comprises pocket 154. In the permanently adhered liner pocket construction, Panel 102 is folded under panel 104 with essentially the whole back of panel 102 adhered to the back of panel 104. Panel 106 is folded over panel 104, with the front of panel 106 in contact with the front of panel 104. Panel 108 is folded over panel 106 with the back of panel 108 adhered to essentially the entire back of panel 106. The back of panel 108 is also adhered on sides 156, 158 and 160 to panel 104; and on side 160, inward from sides 156 and 158 it is adhered to cloth liner 148 of cover 140. Panel 104 is adhered, on three sides past panel 102, to cloth liner 148 of cover 140.

Figure 14:
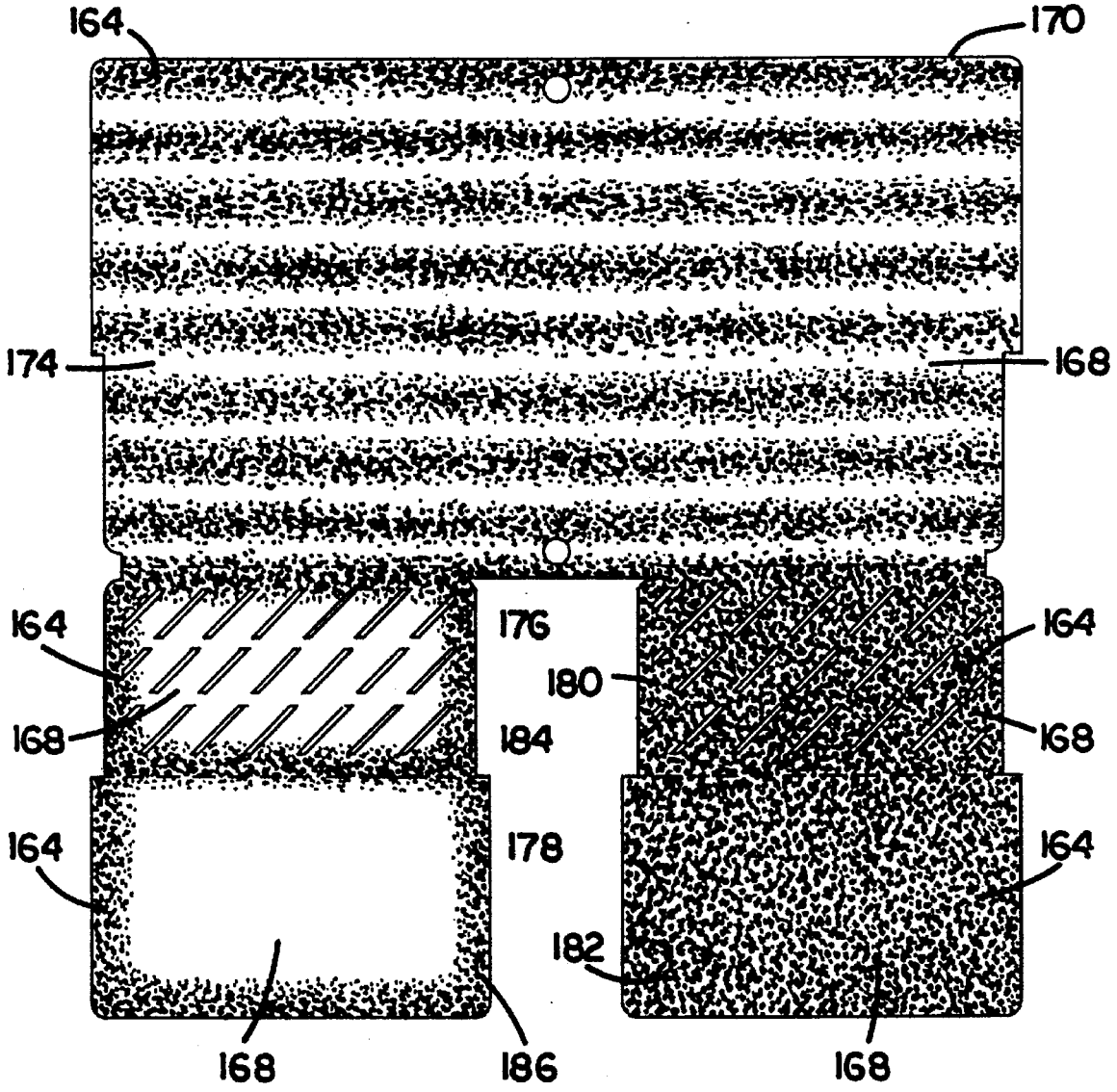
FIG. 14 is a back view of another liner according to the invention.

In FIG. 14, glue 164 covers the back 168 of liner 170. The glue is applied by spraying it on liner 170 just before folding. Here the liner is die cut in quantity in advance and stored for coating, folding, and gluing on a cover.

Since panel portions 174, 176, 178, 180 and 182 are die cut from the same sheet, their backs are all shown and designated "168" in FIG. 14.

After die cut liner 170 is folded and mounted on a looseleaf cover as described and shown earlier for a similar liner; back 168 of panel portion 174 is in contact with a looseleaf cover.

Back 168 of panel portion 176 is in contact with back 168 of panel portion 178. Although the glue covered side of panel portion 176 comes in contact with the glue covered side of panel portion 178, the pattern 184 of glue on panel portion 176 misses the pattern 186 of glue on panel portion 178 so that back 168 is glued to itself by glue that originates on each of the opposed contacting panel portions. In this arrangement faster drying is promoted by the single layer of glue between contacting surfaces of the liner, rather than a layer of glue from one panel portion adding to and further wetting a layer of glue from the other panel portion.

In panel portions 180 and 182 the glue is applied continuously and covers essentially the entire surface of each panel portion. This provides additional benefit for use of a glue that provides enhanced sticking properties when it is in contact with itself.

In FIG. 15, application of the glue continuously and over essentially the entire surface of liner 192, instead of applying the glue in a pattern that is synchronized to the shape of the panel portion as in panel portions 176 and 178, benefits in application of the glue with a plain roller or brush without regard to orientation or shape of the liner, by hand or with less costly machinery.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A method of making a cover pocket, comprising:

taking a flexible sheet, the back of which is coated with an energy responsive adhesive, and in any order:

(a) folding the sheet between a first panel portion of the sheet and a second panel portion of the sheet so that the front of the second panel portion is in contact with the front of the first panel portion, (b) folding the sheet between a third panel portion and the second panel portion of the sheet so that the back of the third panel portion is in contact with the back of the second panel portion, (c) forming the dimensions of the panel portions so that an end of the third panel portion extends beyond the second panel portion when the third panel portion is in contact with the second panel portion.

2. The method of claim 1, further comprising:

forming the dimensions of the panel portions so that an end of the first panel portion extends beyond the second panel portion when the first panel portion is in contact with the second panel portion.

3. The method of claim 2, further comprising:

making the second panel portion gas permeable.

4. The method of claim 3, further comprising:

making the second panel portion gas permeable by perforating the second panel portion.

5. The method of claim 1, further comprising:

applying activating energy to the folded sheet while the back of the folded sheet is against a cover until the back of the first panel portion adheres to the cover, the back of the second panel portion adheres to the back of the third panel portion, and the back of the third panel portion adheres to the front of the first panel portion.

6. The method of claim 5, further comprising:

making the second panel portion gas permeable.

7. The method of claim 5, further comprising:

applying said energy to essentially the entire surface of the folded sheet.

8. The method of claim 7, further comprising:

applying said energy along a line which moves across said folded sheet.

9. The method of claim 7, further comprising:

applying said energy simultaneously to said essentially entire surface.

10. A method of making a cover pocket, comprising:

taking a flexible sheet, the back of which is coated with an energy responsive adhesive, and in any order:

(a) folding the sheet between a first panel portion of the sheet and a second panel portion of the sheet so that the back of the second panel portion is in contact with the back of the first panel portion, (b) forming the dimensions of the panel portions so that an end of the first panel portion extends beyond the second panel portion when the back of the first panel portion is in contact with the back of the second panel portion;

and then after steps of (a) and (b) :

applying activating energy to the folded sheet with the back of the folded sheet against a cover until the back of the first panel portion adheres to the cover, and the back of the first panel portion adheres to the back of the second panel portion.

11. The method of claim 10, further comprising:

making the second panel portion gas permeable.

12. The method of claim 11, further comprising:

in any order with steps (a) and (b), scoring the sheet at the line of fold.

13. The method of claim 10, further comprising:

in any order with steps (a) and (b), scoring the sheet at the line of fold.

14. The method of claim 10, wherein:

in step (b), at least two ends of the first portion extend beyond the second panel portion when the back of the first panel portion is in contact with the back of the second panel portion.

15. A method of making a cover pocket, comprising:

taking a flexible sheet, the back of which is coated with a glue, and in any order:

(a) folding the sheet between a first panel portion of the sheet and a second panel portion of the sheet so that the front of the second panel portion is in contact with the front of the first panel portion, (b) folding the sheet between a third panel portion and the second panel portion of the sheet so that the back of the third panel portion is in contact with the back of the second panel portion, so that glue originating on one of the back of the second panel portion and the third panel portion is in contact with the back of the other panel portion.

16. The method of claim 15, further comprising:

forming the dimensions of the panel portions so that an end of the third panel portion extends beyond the second panel portion when the third panel portion is in contact with the second panel portion.

17. The method of claim 16, further comprising:

forming the dimensions of the panel portions so that an end of the first panel portion extends beyond the second panel portion when the first panel portion is in contact with the second panel portion.

18. The method of claim 15, further comprising:

folding the sheet between the third panel portion and the second panel portion of the sheet so that glue originating on the back of the second panel portion is in contact with the third panel portion, and glue originating on the third panel portion is in contact with the back of the second panel portion.

19. The method of claim 15, further comprising:

folding the sheet between the third panel portion and the second panel portion of the sheet so that glue originating on the back of the second panel portion is in contact with glue originating on the back of the third panel portion.

20. A method of making a cover pocket, comprising:.

taking a flexible sheet, the back of which is coated with a glue, and folding the sheet so that the back is glued to itself by the glue coating and fastening the back of the sheet by the glue coating on the back of the sheet to a cover.

21. The method of claim 20, further comprising:

folding the sheet a second time, such that the front of the sheet is in contact with itself, and wherein the folds are made on parallel creases.

* * * * *